United States Patent [19]

Tutikawa

[11] Patent Number: 5,070,578

[45] Date of Patent: Dec. 10, 1991

[54] HINGE WITH SPACED APART HINGE MEMBERS

[76] Inventor: Yoshiji Tutikawa, 3-7-20 Hiranoniisi, Hirano-ku, Osaka 547, Japan

[21] Appl. No.: 595,629

[22] Filed: Oct. 9, 1990

Related U.S. Application Data

[63] Continuation of Ser. No. 308,621, Feb. 10, 1989, abandoned.

[51] Int. Cl.[5] ..... E05D 15/32; E05D 5/00

[52] U.S. Cl. ..... 16/370; 16/387

[58] Field of Search ..... 16/365, 391, DIG. 43, 16/387, 370

[56] References Cited

U.S. PATENT DOCUMENTS 1,053,900 2/1913 Bradley ..... 16/391

1,142,584 6/1915 Krah ..... 16/270

3,940,829 3/1976 Grunert et al. ..... 16/366

*Primary Examiner*—Robert L. Spruill

*Assistant Examiner*—Carmine Cuda

*Attorney, Agent, or Firm*—Lowe, Price, LeBlanc & Becker

[57] ABSTRACT

A hinge which includes a plurality of hinge members which are spaced apart and parallely aligned with each other. Each hinge member includes a mounting plate connected to a base for attaching the mounting plate to a wall. The mounting plates are further connected by link members to cuplike pieces which are designed to be inserted into bores cut in a door. The cuplike pieces are integral with an elongate member which secures the cuplike pieces in the door and further maintains the spaced apart parallel relationship between the hinge members.

5 Claims, 3 Drawing Sheets

Figure 1
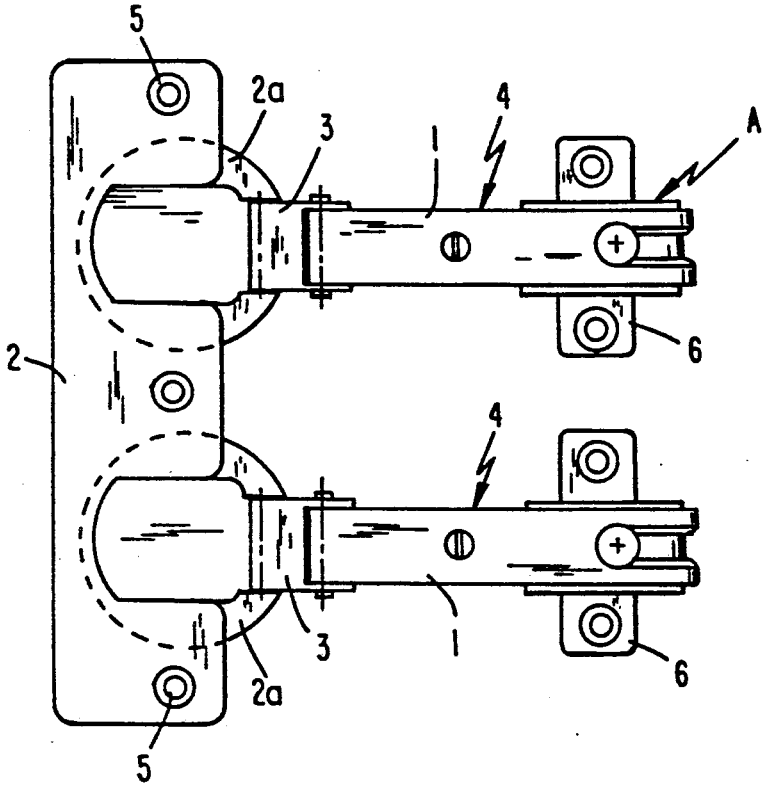
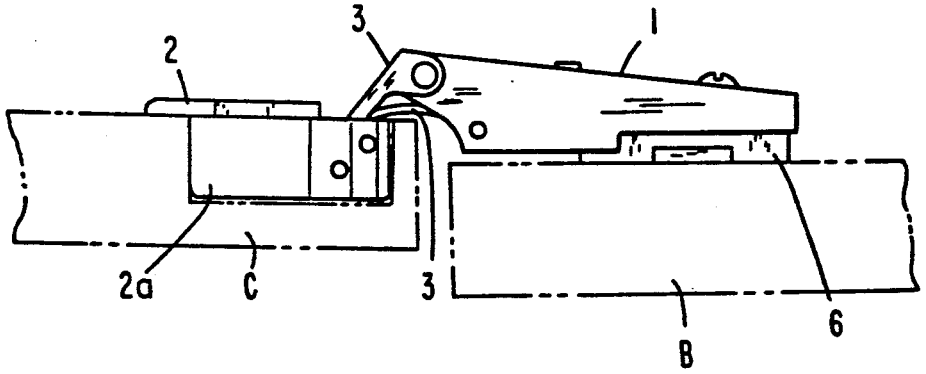
Figure 2

Figure 5
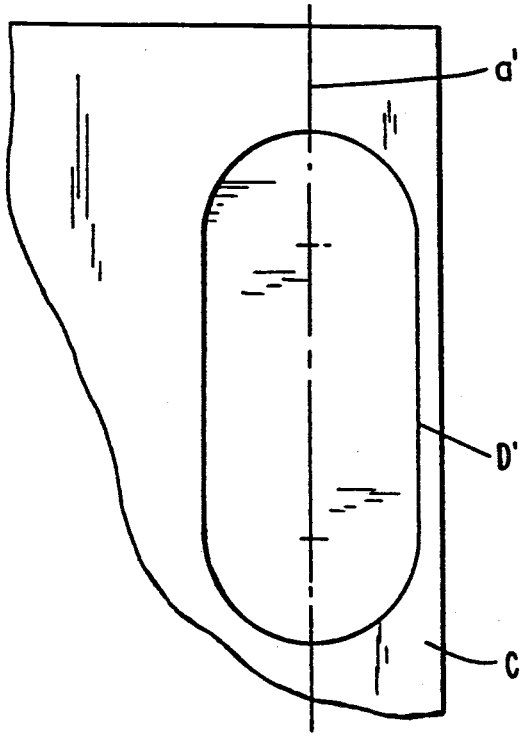
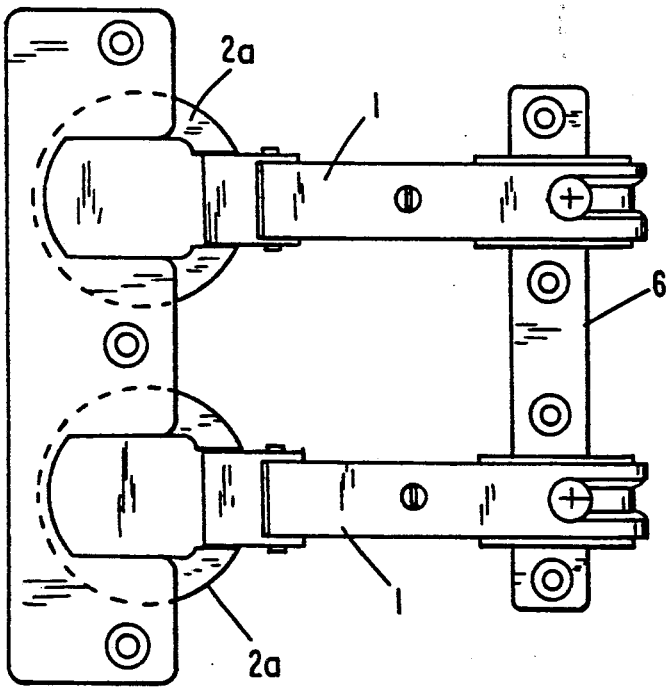
Figure 6

HINGE WITH SPACED APART HINGE MEMBERS

This application is a continuation application of application Ser. No. 07/308,621, filed Feb. 10, 1989, now abandoned.

BACKGROUND OF THE INVENTION

This invention relates to a hinge, that is, the so-called slide hinge, in which mounting plate parts to be secured to the solid wall of the furniture or household goods and cuplike pieces to be secured to the door are connected to each other through a plurality of links.

Nowadays, hinges of the abovesaid type are widely used for the furniture doors and the like and the way of securing the hinge to the door is such that a cuplike piece of the hinge is fitted into a hole prepared on the reverseside of the door beforehand and is fixed thereto with screws.

In general, a door of large size have 4 to 6 sets of hinges secured thereto but these hinges are individually fixed with screws and, therefore, it is greatly troublesome to fix to the door so that the rotational axes of hinges can correctly be aligned on the straight line. When even one of the rotational axes is out of alignment, the door grates and is prevented from smooth opening and closing. Such problems become severe as the number of hinges increases.

A primary object of this invention is to provide a novel hinge which is capable of making fixing work far easier as compared with the conventional work and of leading to reduction in total manufacturing cost.

BRIEF DESCRIPTION OF THE DRAWINGS

FIG. 1 is a plan view of a hinge as a first embodiment of this invention;

FIG. 2 is a side view thereof;

FIG. 5 is a plan view of a recess for fixing said hinge as the 2nd embodiment to the door; and FIG. 6 is a plan view of the other embodiment.

DESCRIPTION OF THE PREFERRED EMBODIMENTS

Figure 4:
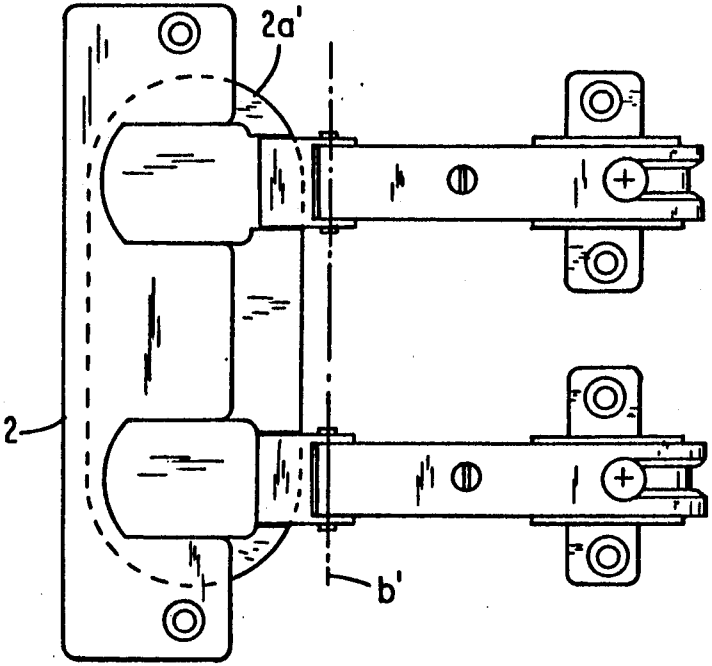
FIG. 4 is a plan view of a hinge as a second embodiment of this invention.
Figure 3:
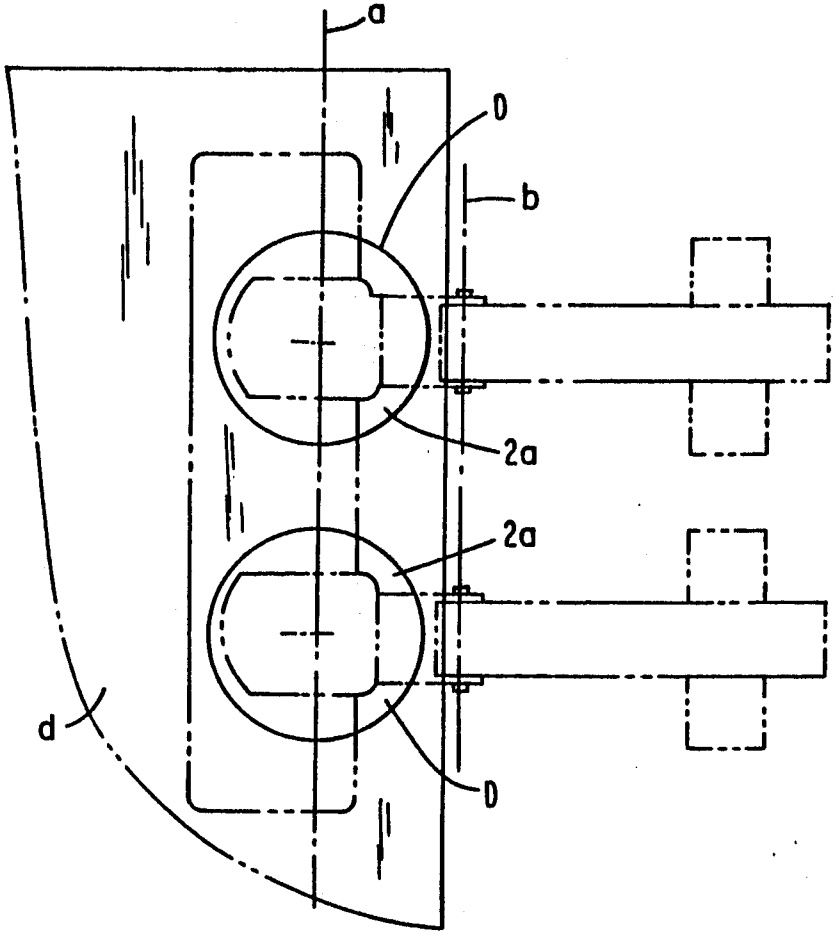
FIG. 3 is a plan view of recesses for fixing said hinge as the 1st embodiment to the door.

Embodiments of this invention will be described with reference to the drawings.

As shown in FIGS. 1 and 2, a hinge of this invention comprises two hinge members 4, 4, which are composed of mounting plate parts 1 to be fixed to the solid wall B of the furniture or household goods and cup pieces 2*a* having a basic circular shape and to be fixed to the door C and connected to this mounting plate part 1 with a pair of links 3, are arranged in parallel with and spaced from each other at an appropriate distance, wherein the cuplike pieces 2*a*, 2*a* are each formed to be integral with a commonly used elongate member 2. The reference numerals 5 . . . indicate screw setting holes on the elongate member and 6, 6 are base pieces of the mounting plates 1.

In the 1st embodiment, cuplike pieces 2*a*, 2*a* are separately formed on the elongate member 2, whereas, in the 2nd embodiment shown in FIG. 4, these pieces are united to be in the shape of one oblong piece 2'.

In the 1st and 2nd embodiments, base pieces 6 of the mounting plates 1 may be made of a commonly usable material to be integral with other as shown in FIG. 6.

In every one of the abovesaid embodiments, although an example of a combination of two hinge members 4, 4 is referred to, the other combination including three of more hinge members may be formed.

When fixing a hinge fabricated as above to the door, in the cases of the 1st and 2nd embodiments, recesses D, D into which the cuplike pieces are to be fitted are provided beforehand in required positions on the door C and then the cup pieces 2*a*, 2*a* are fitted into and fixed to the recesses D, D with screws, whereby a single operation to fit the cuplike pieces 2*a*, 2*a* into the recesses D, D enables spontaneous parallelization between the center line a passing through recesses and turning axes b of the hinges, whereby the use of a setting gauge is not required and the setting operation is made very easy.

In the 2nd embodiment as shown in FIG. 4, too, an oblong cuplike piece 2*a*' fitted into an oblong recess D' disposed at a required position on the door C, and fixed with screws may satisfy the purpose. In this way, similarly to the 1st embodiment, the line a' along the lengthwise direction of the recess D' can be made spontaneously parallel with turning axis b' of the hinges.

This invention provides such a structure as described in detail above and exhibits the following effects: in the 1st embodiment in which cuplike pieces of hinge members are individually formed on the elongate member, fitting of the cuplike pieces into respective recesses formed in required positions and fitted with screws thereto spontaneously enables the lines passing through all recesses to run in parallel with the turning axes b of the hinges, and in the 2nd embodiment, an oblong cuplike piece formed of united two pieces to be fitted into an oblong recess prepared beforehand on the door fixed with screws thereto also spontaneously enables the line a' to be parallel with the turning axis b of hinges, whereby grating of the door because of weight deviation to the turning axis of the hinges and unsmooth movement of the door can be prevented beforehand as well as hinge setting operation becomes very easy. In addition, the cuplike pieces of the hinge members are integral with each other which permits reduction in total cost for manufacturing hinges as compared with individual fabrication.

I claim:

1. A hinge comprising a plurality of spaced apart parallely aligned hinge members having mounting plates to be secured to a solid wall and an oblong cuplike piece to be secured to a door, said oblong cuplike piece being connected to said mounting plates by link members which provide a pivoting axis for the hinge members between said link members and said mounting plates and formed integrally with a common elongate member which maintains said spaced apart parallel relationship between said plurality of hinge members.

2. A hinge member according to claim 1, further including base members attached to said mounting plates for attaching said mounting plates to the solid wall.

3. A hinge member according to claim 2, wherein said base members are adjustably connected to said mounting plates.

4. A hinge member according to claim 1, wherein said elongate member includes means for securing said elongate member to the door.

5. A hinge member according to claim 1, wherein each link member comprises a pair of links.

* * * * *